US006789438B2

(12) United States Patent
Tanaka et al.

(10) Patent No.: US 6,789,438 B2
(45) Date of Patent: Sep. 14, 2004

(54) ENGINE STARTING APPARATUS

(75) Inventors: Masashi Tanaka, Saitama (JP); Mikihiro Takano, Saitama (JP); Nobuyuki Hiramatsu, Saitama (JP); Takashi Aoki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/041,595

(22) Filed: Jan. 10, 2002

(65) Prior Publication Data

US 2002/0088286 A1 Jul. 11, 2002

(30) Foreign Application Priority Data

Jan. 10, 2001 (JP) ..... P. 2001-003056
Oct. 23, 2001 (JP) ..... P. 2001-325604

(51) Int. Cl.[7] ..... F02N 15/06
(52) U.S. Cl. ..... 74/7 E; 74/7 A; 476/67
(58) Field of Search ..... 74/7 R, 7 A, 7 E; 476/65, 66, 67, 70

(56) References Cited

U.S. PATENT DOCUMENTS 3,945,270 A * 3/1976 Nelson et al. ..... 74/798
4,555,963 A * 12/1985 Nelson ..... 74/798
4,635,489 A * 1/1987 Imamura et al. ..... 74/7 E
4,709,589 A * 12/1987 Kraus ..... 74/206
5,533,415 A * 7/1996 Ackermann et al. ..... 74/7 E
5,857,380 A * 1/1999 Kajino et al. ..... 74/7 E
5,905,309 A * 5/1999 Ohmi et al. ..... 74/7 E
5,931,759 A * 8/1999 Otaki et al. ..... 475/195
6,397,808 B1 * 6/2002 Tanaka et al. ..... 74/7 E

FOREIGN PATENT DOCUMENTS

JP 9-310667 12/1997
JP 10-311398 11/1998

* cited by examiner

*Primary Examiner*—Christopher P. Schwartz
*Assistant Examiner*—Mariano Sy
(74) *Attorney, Agent, or Firm*—Arent Fox PLLC

(57) ABSTRACT

An engine starting apparatus includes a starter motor rotating when the engine is started, a wedge roller speed reduction mechanism adapted to output a rotation of the starter motor from an output shaft at a reduced speed and to cut off power transmission between the starter motor and the output shaft when the rotational speed of the output shaft exceeds the reduced speed, a pinion gear provided on the output shaft in such a manner as to rotate together with the output shaft and to move axially over the output shaft between an engagement position where the drive gear is mesh engaged with a ring gear and a disengagement position where the pinion gear is disengaged with the ring gear, and a magnet switch for driving the pinion gear to the engagement position when the engine is started and to the disengagement position after the engine has been started.

4 Claims, 4 Drawing Sheets

ENGINE STARTING APPARATUS

BACKGROUND OF THE INVENTION

1. Field of the Invention

The present invention relates to an engine starting apparatus for starting an engine by driving to rotate the engine with a starter motor, and more particularly to a so-called solenoid driven type engine starting apparatus for starting an engine when a drive gear connected to a starter motor is moved to a driven gear of the engine for mesh engagement with the driven gear.

2. Description of the Related Art

Conventionally, an engine starting apparatus of the above-mentioned type is known as disclosed in Japanese Patent Unexamined Publication Hei.9-310667. This engine starting apparatus includes a starter motor, a planetary gear speed reduction mechanism connected to the starter motor, a pinion gear movably provided on an output shaft of the planetary gear speed reduction mechanism for mesh engagement with a ring gear provided on a crankshaft of the engine, a one-way clutch provided integrally on the pinion gear, and a magnet switch for moving said pinion gear on the output shaft between a position where the pinion gear is brought into mesh engagement with the ring gear and a position where the pinion gear is brought out of mesh engagement with the ring gear. This one-way clutch is constructed so as to provide for power transmission between the output shaft and the pinion gear when the rotational speed of the pinion gear is smaller than the rotational speed of the output shaft of the planetary gear speed reduction mechanism and to cut off power transmission between the starter motor and the output shaft when the rotational speed of the pinion gear is greater than the rotational speed of the output shaft of the planetary gear speed reduction mechanism.

In this engine starting apparatus, when an engine starting operation through an ignition key is performed in an attempt to start the engine, the starter motor starts to rotate, and the rotation of the starter motor is transmitted to the output shaft by the planetary gear speed reduction mechanism at reduced speeds, whereby the pinion gear is rotated. At the same time, the magnet switch moves the pinion gear together with the one-way clutch to the ring gear side for mesh engagement with the ring gear, whereby the rotational force of the starter motor is transmitted to the engine via the planetary gear speed reduction mechanism, the output shaft, the one-way clutch, the pinion gear and the ring gear to start the engine. Then, after the engine has been started, the magnet switch moves the pinion gear in a direction in which the pinion gear moves apart from the ring gear for release the mesh engagement between the pinion gear and the ring gear. As this occurs, when the rotational speed of the pinion gear driven by the engine comes to increase over the rotational speed of the output shaft of the planetary gear speed reduction mechanism which is driven by the starter motor after the engine has been started, the rotational force of the engine is not transmitted to the starter motor side by the operation of the one-way clutch, whereby the forced excessive rotation of the starter motor by the engine is avoided.

According to the aforesaid conventional engine starting apparatus, since the one-way clutch needs to be moved together with the pinion gear when the engine is attempted to be started, as this actually occurs, the resulting inertia mass becomes equal to the sum of the masses of those two components, and this causes problems that louder impact noise tends to be generated when the pinion gear is brought into mesh engagement with the ring gear and hence that the durability of those components tends to be deteriorated. In addition, the driving force needed to drive the one-way clutch as well as the pinion gear increases for the same reason, and this increases in turn the size of the magnet switch and requires a longer time before the pinion gear and the one-way clutch actually start to move, leading to the slow response of those components when they need to operated. Furthermore, since the construction requires the one-way clutch and the planetary gear speed reduction mechanism, the casing of the apparatus has to be enlarged for accommodation of those components therein. In addition, since the speed reduction is implemented through meshing of the gears in the planetary gear speed reduction mechanism, there is caused a problem that the operation noise gets relatively louder.

SUMMARY OF THE INVENTION

The invention was made with a view to solving the problems, and an object thereof is to provide an engine starting apparatus which can attain entirely reduction of noise, miniaturization of the engine starting apparatus and improvement in durability thereof.

With a view to attaining the object, according to a first aspect of the invention, there is provided an engine starting apparatus 1 comprising a driven gear (for example, a ring gear 23 in an embodiment (referred to as the same in this first aspect)) connected to an engine, a starter motor 3 for starting the engine which is adapted to be driven to rotate when the engine is started, a speed-reduction and power-cut-off mechanism (a wedge roller type speed reduction mechanism 10) connected to the starter motor 3 and having an rotatable output shaft 19, which speed-reduction and power-cut-off mechanism is adapted to output a rotation of the starter motor 3 from the output shaft 19 at a reduced speed and to cut off power transmission between the starter motor 3 and the output shaft 19 when the rotational speed of the output shaft 19 exceeds the rotational speed thereof resulting after the speed reduction is implemented for the output of rotations of the starter motor 3, a drive gear (a pinion gear 4) provided on the output shaft 19 in such a manner as to rotate together with the output shaft 19 and to move axially over the output shaft 19 between an engagement position (a position shown in FIG. 4B) where the drive gear is brought into mesh engagement with the driven gear (the ring gear 23) and a disengagement position (a position shown in FIG. 4A) where the drive gear is brought out of engagement with the driven gear (the ring gear 23), and a driving unit (a magnet switch 5) for driving the drive gear (the pinion gear) to the engagement position when the engine is started and to the disengagement position after the engine has been started.

According to the engine starting apparatus, when the engine is started, the starter motor is driven to rotate, and the rotation of the starter motor is transmitted to the drive gear via the output shaft at the reduced speed by the speed-reduction and power-cut-off mechanism. In addition, the drive gear is driven to the engagement position by the driving unit for mesh engagement with the driven gear, whereby the power of the starter motor is transmitted to the engine via the drive gear and the driven gear which is in mesh engagement with the drive gear to start the engine. After the engine has been started, the drive gear is driven to the disengagement position, whereby the mesh engagement between the drive gear and the driven gear is cancelled. As this occurs, since the power transmission between the output shaft and the starter motor is prevented when the rotational speed of the output shaft exceeds the rotational speed thereof resulting after the rotational speed of the starter motor is reduced by the speed-reduction and power-cut-off mechanism, the forced excessive rotation of the starter motor by the engine is avoided after the engine has been started. Namely, since the speed-reduction and power-cut-off mechanism functions as a one-way clutch, the mechanism is different from the conventional example in that there is no need to provide a one-way clutch together with drive gear, whereby the inertia mass of the drive gear can be reduced by that extent, thereby making it possible to reduce the impact noise generated when the drive gear is brought into mesh engagement with the driven gear and to improve the durability of the gears. In addition, the driving unit for driving the drive gear can be miniaturized for the same reason, this leading to the miniaturization of the whole of the apparatus in the end. In addition, since the drive gear is allowed to move quickly, the response when the engine is started can be improved.

According to a second aspect of the invention, there is provided an engine starting apparatus 1 as set forth in the first aspect of the invention, wherein the speed-reduction and power-cut-off mechanism is constituted by a wedge roller type speed reduction mechanism 10.

According to this engine starting apparatus, since the wedge roller type speed reduction mechanism is employed, the engine starting apparatus of the invention is different from the conventional planetary gear speed reduction mechanism in that noise can be reduced by such an extent that there is produced no mesh engagement of gears.

DETAILED DESCRIPTION OF THE PREFERRED EMBODIMENTS

Figure 1:
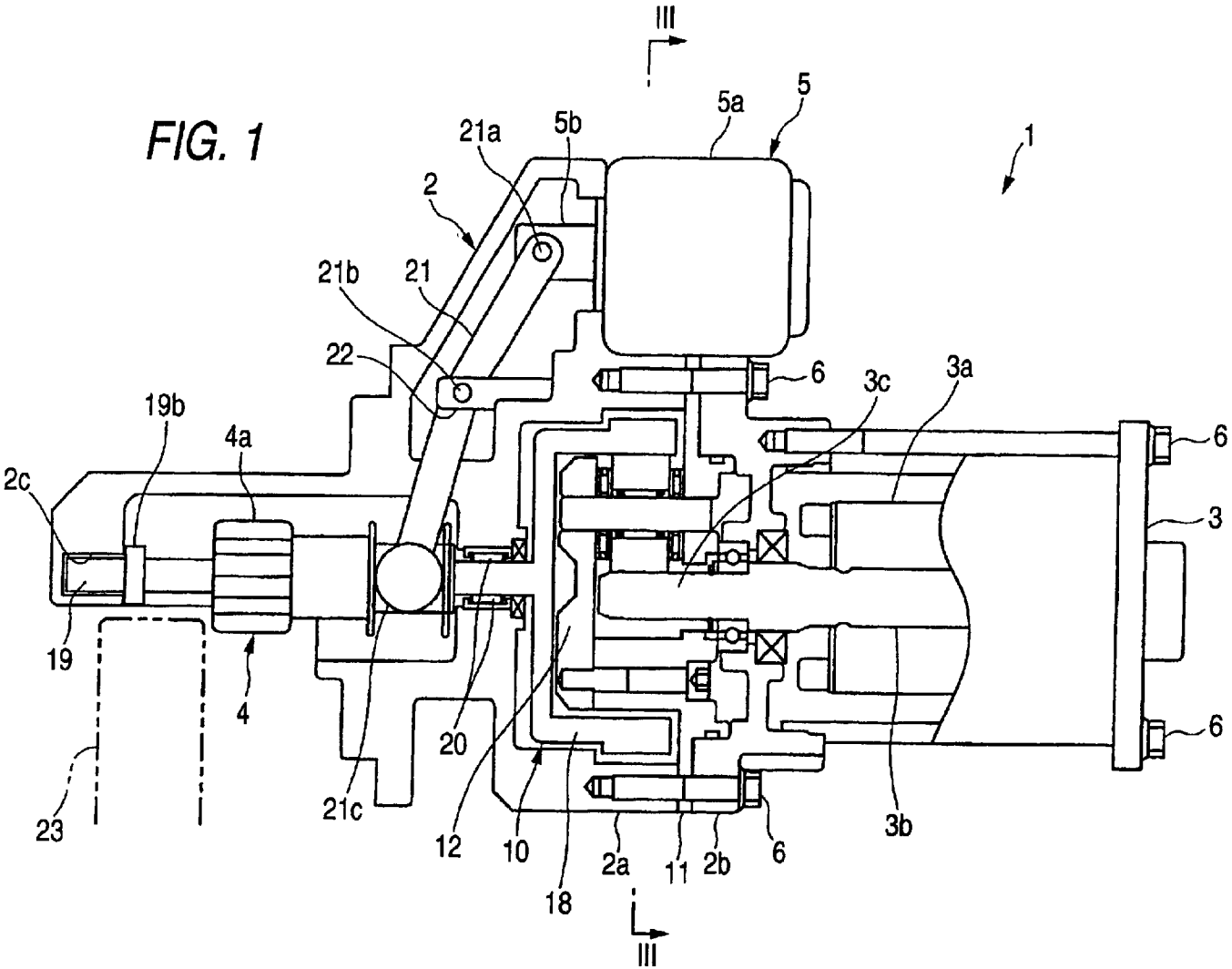
FIG. 1 is a partially cut away side view showing schematically the construction of an engine starting apparatus according to an embodiment of the invention.

An engine starting apparatus according to an embodiment of the invention will be described below with reference to the appended drawings. FIG. 1 is a side view, partially cut away, of an engine starting apparatus 1 of an embodiment of the invention. In the figure, left and right sides thereof correspond to front and rear sides of the engine starting apparatus 1, respectively, and in order to facilitate the clarification of the diagram, hatching sectional portions is omitted (and the same is also applied to FIGS. 2 to 4B).

As will be described later, this engine starting apparatus 1 is of the solenoid driven type, in which when an engine (not shown) is started, a pinion gear 4 (a drive gear) is moved forward so as to be brought into mesh engagement with a ring gear 23 (a driven gear) provided on a crankshaft (not shown) of the engine, and the engine is driven to rotate with a starter motor 3 in this state, so that the engine is started.

The engine starting apparatus 1 includes a casing 2, the starter motor 3, a wedge roller type speed reduction mechanism 10, the pinion gear 4 and a magnet switch 5. The starter motor 3 is mounted on the casing 2. The wedge roller type speed reduction mechanism 10 (a speed-reduction and power-cut-off mechanism) is connected to a rotational shaft 3*b*, which will be described later, of the starter motor 3. The pinion gear 4 is provided on an output shaft 19, which will be described later, of the wedge roller type speed reduction mechanism 10, in such a manner as to freely move in the longitudinal direction. The magnet switch 5 drives the pinion gear 4 in the longitudinal direction.

In the casing 2, two front and rear casing members 2*a*, 2*b* are disposed so as to hold an edge portion of a first roller supporting plate 11, which will be described later, therebetween from front and rear, and the casing members 2*a*, 2*b* and the roller supporting plate 11 are coupled together with a plurality of bolts 6 (only two of them being shown in the figure). The starter motor 3 is mounted on a rear end portion of the casing 2 with a plurality of bolts 6 (only two of them being shown in the figure).

This starter motor 3 is constituted by an electric motor and is driven to rotate by a driving power supplied from a control device (not shown), when the engine is started. The starter motor 3 includes a stator (not shown) and a rotor 3*a* accommodated in the stator. This rotor 3*a* is constructed such that a coil is wound around the rotational shaft 3*b*, and the rotational shaft 3*b* extends longitudinally through a hole formed in a central portion of the first roller supporting plate 11 and is rotatably supported on a radial ball bearing 7 (refer to FIG. 2) provided on the rear casing member 2*b* and the like. A front end of the rotational shaft 3*b* is formed into a roller portion 3*c* having a circular cross section. Three rollers 15 to 17, which will be described later, of the wedge roller type speed reduction mechanism 10 are brought into abutment with the roller portion 3*c* with an oil film of hydraulic oil, which will be described later, being interposed therebetween, and an outer circumferential surface of the roller portion 3*c* serves as a rolling surface for the three rollers 15 to 17. In addition, a central portion of an outer circumferential surface of the rotational shaft 3*b* is fitted into a seal 8*a* provided in the rear casing member 2*b*, and an interior space in the casing 2 is held fluid tightly with the seal 8*a* and a seal 8*b* provided in the front casing member 2*b*. Hydraulic oil is filled in the casing 2, as well as the wedge roller type speed reduction mechanism 10.

The wedge roller type speed reduction mechanism 10 has a one-way clutch function as well as a speed reduction function. As will be described later, the rotation of the starter motor 3 is outputted from the output shaft 19 of the wedge roller type speed reduction mechanism 10 at reduced speeds only when the starter motor 3 rotates in an engine starting direction (in a clockwise direction in FIG. 3). Additionally, the power transmission between the starter motor 3 and the output shaft 19 is cut off when the rotational speed of the output shaft 19 exceeds the reduced rotational speed of the starter motor 3.

Figure 2:
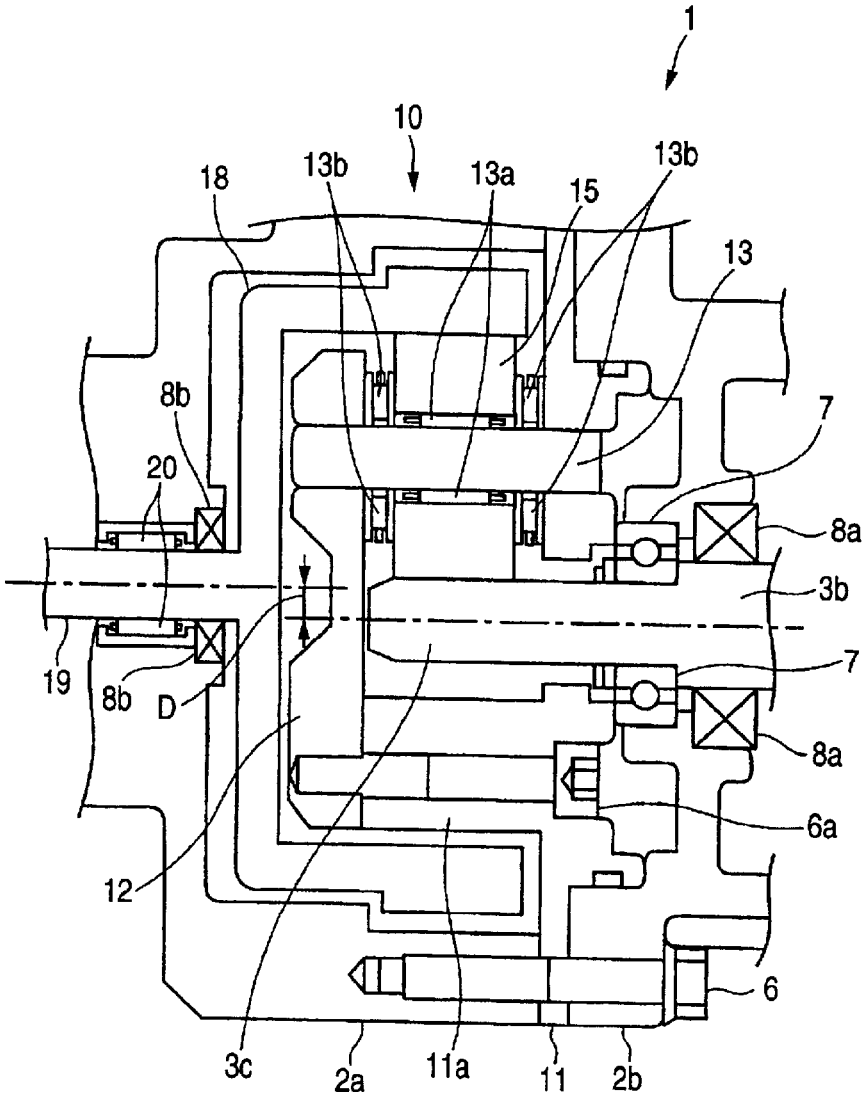
FIG. 2 is an enlarged view of part of FIG. 1.
Figure 3:
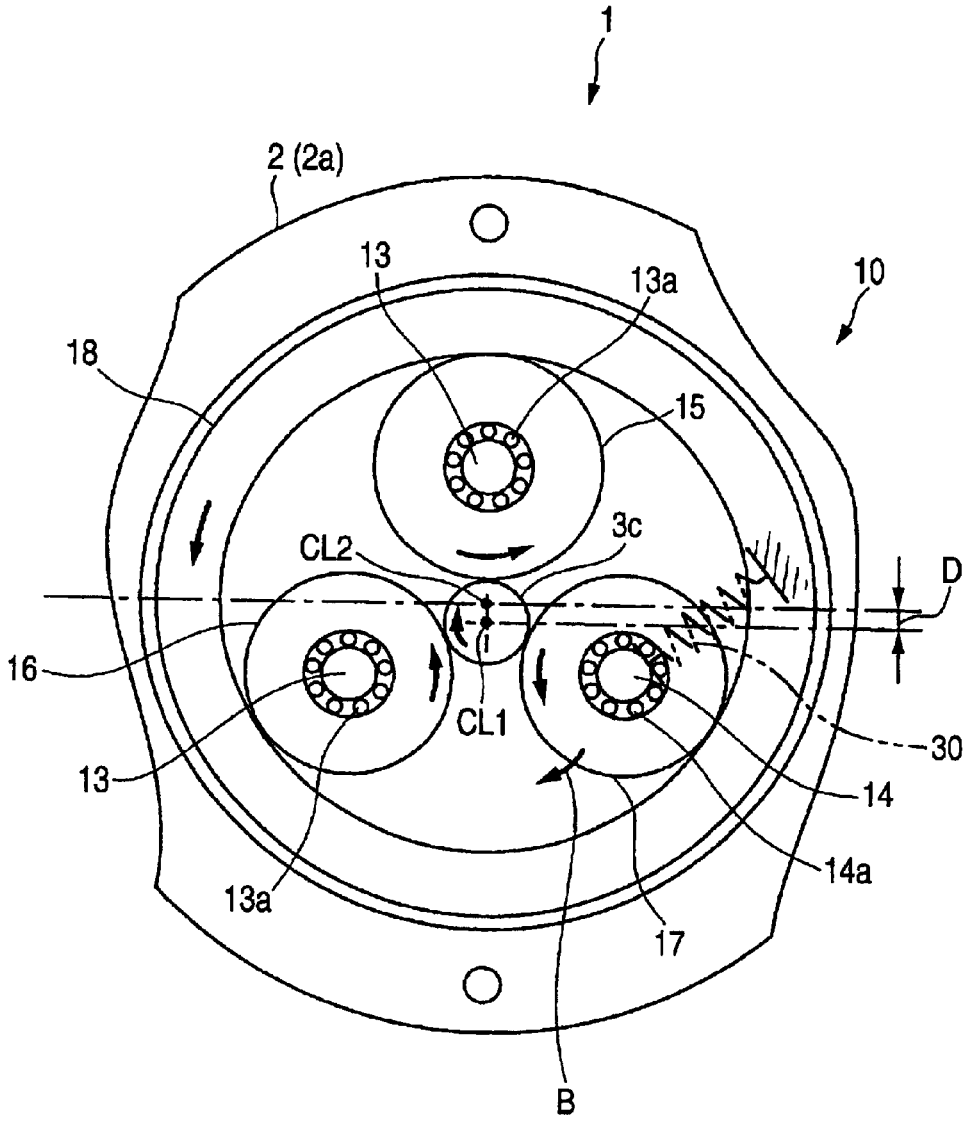
FIG. 3 is a cross-sectional view as viewed in a direction indicated by arrows III—III in FIG. 1.
Figure 4A:
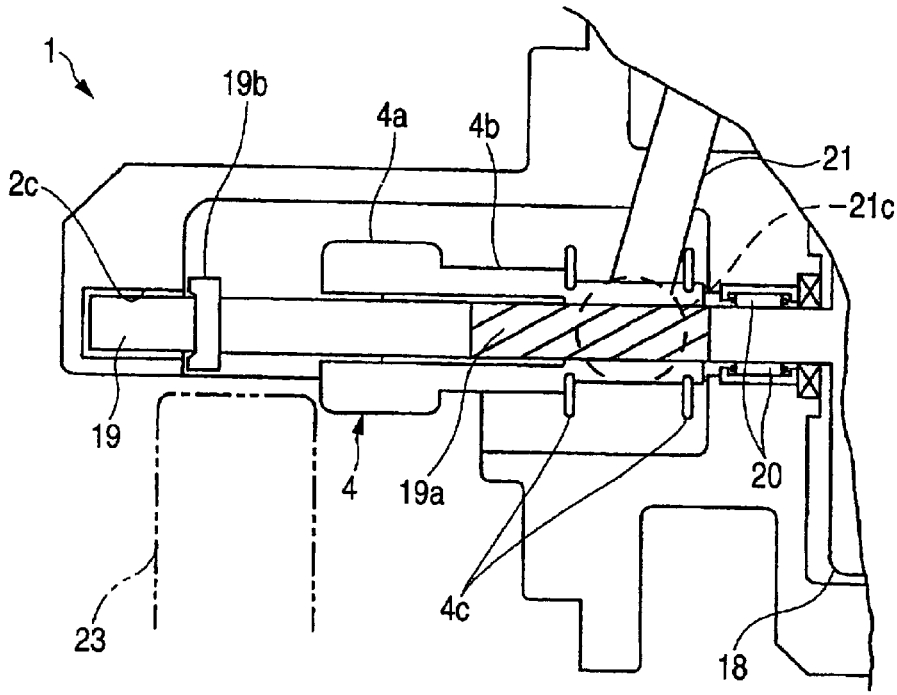
FIG. 4A is an explanatory view showing a state in which a pinion gear of the engine starting apparatus is situated at a disengagement position.
Figure 4B:
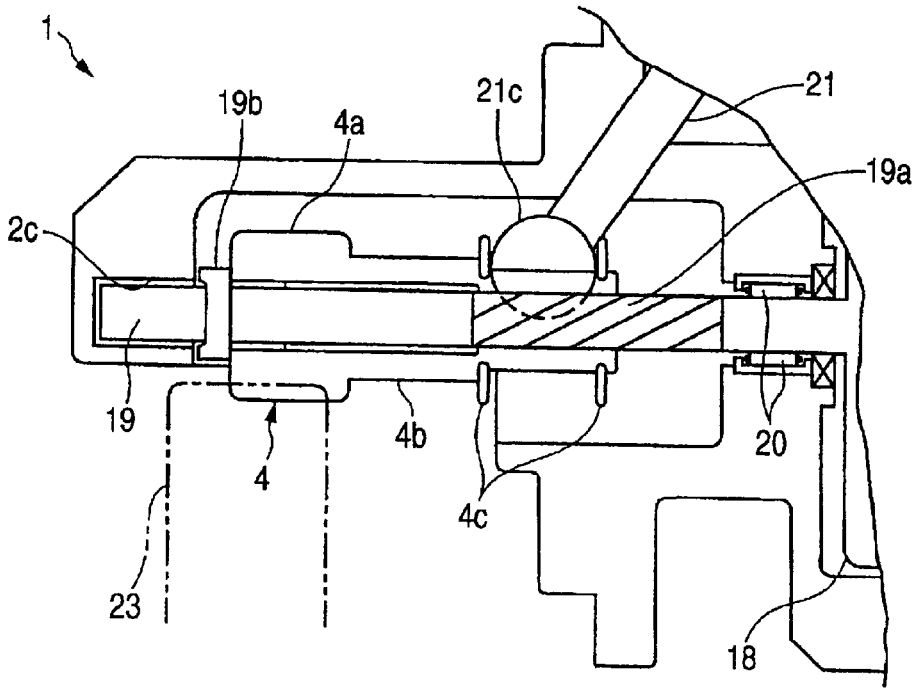
FIG. 4B is an explanatory view showing a state in which the pinion gear is situated at an engagement position.

As shown in FIGS. 2 and 3, the wedge roller type speed reduction mechanism 10 comprises the first roller supporting plate 11, a second roller supporting plate 12, stationary supporting shafts 13, 13 and a movable supporting shaft 14, respectively extending in the longitudinal direction, first and second guide rollers 15, 16 provided on the stationary supporting shafts 13, 13, respectively, a wedge roller 17 provided on the movable supporting shaft 14, a bottomed cylindrical outer ring 18 and the output shaft 19 provided integrally and concentrically with the outer ring 18 and extending in the longitudinal direction.

The first roller supporting plate 11 has amounting portion 11*a* which projects forwardly, and the mounting portion 11*a* is formed with a hole penetrating in the longitudinal direction. A bolt 6*a* with a hexagonal hole in its head is screwed into a threaded hole of the second roller supporting plate 12 so as to be fastened therein while passing through the hole of the mounting portion 11*a*, whereby the first and second roller supporting plates 11, 12 are assembled together in such a state as to face to each other with a predetermined interval.

The respective stationary supporting shafts 13 are fixed, in such a state that they extend between the two roller supporting plates 11, 12. The first and second guide rollers 15, 16 are formed in a ring shape and the first guide roller 15 has a diameter which is slightly larger than that of the second guide roller 16. Additionally, each of the guide rollers 15, 16 is rotatably supported on the stationary supporting shaft 13 via a needle roller bearing 13*a* and is further supported from front and rear by the two roller supporting plates 11, 12 via two thrust bearings 13*b*, 13*b*.

On the other hand, the movable supporting shaft 14 extends between the two roller supporting shaft 11, 12 and is fitted with a play into two holes (not shown) formed in facing surfaces of the two roller supporting plates 11, 12 at front and rear end portions thereof. Thus, the movable supporting shaft 14 is allowed to slightly move both in circumferential and radial directions of the outer ring 18, and is biased in a clockwise direction as viewed in FIG. 3 (a direction indicated by an arrow B in FIG. 3) along the circumferential direction of the outer ring 18 at all times by a spring 30. Hereinafter, unless stated otherwise, the clockwise direction in FIG. 3 is to be referred simply to as the "clockwise direction" and a counterclockwise direction in FIG. 3 as a "counterclockwise direction".

In addition, the wedge roller 17 is formed in a ring shape and has the same diameter as that of the second roller 16. Similarly to the second roller 16, the wedge roller 17 is rotatably supported on the movable shaft 14 via a needle roller bearing 14*a* and is further supported from front and rear by the two roller supporting plates 11, 12 via two thrust bearings (not shown).

Furthermore, the three rollers 15 to 17 are respectively brought into abutment with an inner circumferential surface of the outer ring 18 with an oil film of hydraulic oil being interposed therebetween, as well as with an outer circumferential surface of the roller portion 3*c* of the rotational shaft 3*b* with an oil film of hydraulic oil being interposed therebetween. The rotational center CL1 of the roller portion 3*c* is offset downwardly by a predetermined distance D from the rotational center CL2 of the outer ring 18 (i.e., the output shaft 19). Accordingly, the gap between the inner circumferential surface of the outer ring 18 and the outer circumferential surface of the roller portion 3*c* is the widest between the highest portions of the outer ring 18 and the roller portion 3*c*, becomes narrower as it goes down, and is the narrowest at lowest portions of the two components.

In this embodiment, the first guide roller 15 is brought into abutment with the outer ring 18 and the roller portion 3*c* at the widest gap portion with the oil film being interposed therebetween. In addition, the second guide roller 16 and the wedge roller 17 are brought into abutment with the outer ring 18 and the roller portion 3*c*, respectively, with the oil film being interposed therebetween at left and right locations lower than the rotational center CL1 of the roller portion 3*c*.

On the other hand, the output shaft 19 protrudes forwardly from a front wall portion of the outer ring 18, and a front end portion of the output shaft 19 is fitted into a bearing hole 2*c* formed in a front end portion of the front casing member 2*a* whereas the output shaft 19 is rotatably supported on a needle roller bearing 20 formed in the front casing member 2*a* at a portion thereof which is in the vicinity of the outer ring 18. Thus, the output shaft 19 and the outer ring 18 are rotatably supported in the front casing member 2*a* via the needle roller bearing 20 and the guide rollers 15, 16. In addition, a helical spline 19*a* is formed in a portion of the output shaft 19 which is situated forwardly of the needle roller bearing 20 and a stopper 19*b* is provided at a portion of the output shaft 19 which is situated rearward of the bearing hole 2*c*.

Additionally, the pinion gear 4 is fitted on the output shaft 19. A front portion of the pinion gear 4 is formed into a toothed gear portion 4*a* adapted to be brought into mesh engagement with the ring gear 23 whereas a rear portion thereof is formed into a cylindrical driven portion 4*b*. The toothed gear portion 4*a* and the driven portion 4*b* being formed integrally.

A rear half portion of the driven portion 4*b* is made smaller in diameter than a front half portion thereof, and a helical spline (not shown) is formed in an inner circumferential surface of the driven portion 4*b*. The helical spline of the driven portion 4*b* meshes with the helical spline 19*a* formed in the output shaft 19. In addition, two flanges 4*c*, 4*c* are attached to the small-diameter portion of the driven portion 4*b*, and these flanges 4*c*, 4*c* are disposed so as to oppose to each other with a predetermined interval in the longitudinal direction.

On the other hand, the magnet switch 5 (a driving unit) includes a switch main body 5*a* attached to an upper end portion of the casing 2 and a plunger 5*b* adapted to move in longitudinal directions relative to the switch main body 5*a*. A coil spring and a solenoid (either of them being not shown) are provided within the switch main body 5*a*. The plunger 5*b* is held at a position which protrudes from the switch main body 5*a* as shown in FIG. 1 by the biasing force of the coil spring when the plunger is de-energized. When it is energized, the plunger 5*b* is withdrawn into the switch main body 5*a* by the attracting force of the solenoid.

In addition, the plunger 5*b* is connected to the pinion gear 4 via an arm 21. The arm 21 is formed into a V-like shape and is rotatably attached to a front end portion of the plunger 5*b* via a pin 21*a* at an upper end portion of the arm 21 whereas the arm 21 is rotatably attached to a support post 22 provided in the casing 2 via a pin 21*b* at a central portion thereof. Accordingly, the arm 21 is allowed to freely rotate about a horizontal axis with the pin 21*b* functioning as a rotational center. Additionally, a lower end portion of the arm 21 is formed into fitting portions 21*c*, 21*c* (only one of them being shown) which are bifurcated transversely. These fitting portions 21*c*, 21*c* are each formed into a disk-like shape and are fitted on the small-diameter portion of the driven portion 4*b* from left and right, the fitting portions 21*c*, 21*c* being interposed between the two flanges 4*c*, 4*c*.

According to the construction that has been described above, as will be described later, the pinion gear 4 is held at a disengagement position (a position illustrated in FIGS. 1 and 4A) where the pinion gear 4 does not mesh with the ring gear 23 except when the engine is started whereas the pinion gear 4 is driven to move to an engagement position (a position illustrated in FIG. 4B) where the pinion gear 4 meshes with the ring gear 23 when the engine is started.

The operation of the engine starting apparatus 1 will be described below. In the engine starting apparatus 1, when the engine is started, the magnet switch 5 and the starter motor 3 are energized with a driving power fed from a control device at almost the same time in response to the operation of the ignition key. The operation on the starter motor 3 side will be described first.

At the time of starting the engine, when the starter motor 3 is driven by being energized by the control device, the rotational shaft 3*b* or the roller portion 3*c* thereof turns in the clockwise direction. As the roller portion 3*c* turns, a shearing force is generated in the oil films formed between the roller portion 3*c* and the three rollers 15 to 17, as well as between the three rollers 15 to 17 and the outer ring 18. The shearing force so generated turns the outer ring 18 as well as the three rollers 15 to 17 in the counterclockwise direction.

As this occurs, the wedge roller 17 is subjected to a resultant force comprising a reaction force from the outer ring 18 generated when the outer ring 18 is driven to turn in the counterclockwise direction, the shearing force from the oil film between the roller portion 3*c* and the wedge roller 17, and the aforesaid biasing force of the spring, whereby the wedge roller 17 moves in the clockwise direction (a direction indicated by an arrow B in FIG. 3) along the inner circumferential surface of the outer ring 18. As a result, the wedge roller 17 is forced into the narrower portion where the gap between the roller portion 3*c* and the outer ring 18 gets narrower, which increases pressing force between the roller portion 3*c* and the three rollers 15 to 17, as well as between the three rollers 15 to 17 and the outer ring 18, whereby the power of the starter motor 3 is assuredly transmitted to the outer ring 18 or the output shaft 19 via the three rollers 15 to 17. As this occurs, the output shaft 19 turns at a reduced rotational speed resulting when the rotational speed of the starter motor 3 is reduced at a reduction ratio determined by the diameter of the inner circumferential surface of the outer ring 18 and the diameter of the roller portion 3*c*.

On the other hand, when the magnet switch 5 is driven by being energized by the control device, the plunger 5*b* is withdrawn into the switch main body 5*a* against the biasing force of the coil spring by the pulling force of the solenoid. As this occurs, the arm 21 rotates about the pin 21*b* in the clockwise direction as viewed in FIG. 1, and the fitting portions 21*c* of the arm 21 push the flanges 4*c* to the front, whereby the pinion gear 4 is brought into mesh engagement with the ring gear 23. Then, thrust force generated by the rotation of the starter motor 3 and the helical spline 19*a* also acts such that the pinion gear 4 is brought into mesh engagement with the ring gear 23.

Thus, the pinion gear 4 is brought into mesh engagement with the ring gear 23 at almost the same time as the starter motor 3 drives to rotate the output shaft 19, whereby the engine is started. Then, after the engine has been started, when the rotational speed of the output shaft 19 comes to exceed the rotational speed resulting after the rotation of the starter motor 3 is reduced with the wedge roller type speed reduction mechanism 10, the three rollers 15 to 17 are started to be driven by the output shaft 19 or the outer ring 18. Then, the wedge roller 17 is subjected to a resultant force comprising are action force from the roller portion 3*c* resulting when the roller portion 3*c* is driven to turn in the clockwise direction and the shearing force from the oil film formed between the outer ring 18 and the wedge roller 17, whereby the wedge roller 17 starts to move in the counterclockwise direction (in an opposite direction to the direction indicated by the arrow B) along the inner circumferential surface of the outer ring 18 against the biasing force of the spring. Namely, the wedge roller 17 moves toward the wider portion where the gap between the roller portion 3*c* and the three rollers 15 to 17 gets wider. As a result, the pressing force between the roller portion 3*c* and the three rollers 15 to 17, as well as between the three rollers 15 to 17 and the outer ring 18 is almost eliminated, whereby the power transmission between the roller portion 3*c* and the outer ring 18 is cut off. Thus, the one-way clutch operation of the wedge roller type speed reduction mechanism 10 prevents the excessive rotation of the starter motor 3 that would occurs when the starter motor 3 were driven by the engine.

As has been described heretofore, according to the engine starting apparatus 1 of the present invention, since the wedge roller type speed reduction mechanism 10 functions as the one-way clutch, the engine starting apparatus of the invention is different from the conventional one in that the one-way clutch is omitted, so that the inertia mass of the pinion gear 4 can be reduced, thereby making it possible not only to reduce the impact noise generated when the pinion gear 4 meshes with the ring gear 23 but also to improve the durability of the gears. In addition, for the same reason the magnet switch 5 for driving the ring gear 23 can be made smaller in size, thereby making it possible not only to miniaturize the apparatus 1 but also to improve the response of the pinion gear 4 when the engine is started. Furthermore, since the wedge roller type seed reduction gear 10 is different from the conventional planetary gear speed reduction mechanism in that there is no meshing of gears, noise can be reduced.

Note that while the embodiment describes the example in which the wedge roller type speed reduction mechanism 10 is used as the speed-reduction and power-cut-off mechanism having the speed reduction function and the one-way clutch function, the speed-reduction and power-cut-off mechanism is not limited thereto, any mechanism may be employed as long as it possesses the speed reduction and one-clutch functions.

In addition, the starter motor 3 is not limited to the electric motor according to the embodiment, and any motor such as a hydraulic motor may be used as long as it can be driven to turn. Additionally, the drive unit for driving the pinion gear 4 is not limited to the magnet switch 5 according to the embodiment, but any unit such as a hydraulic actuator may be adopted as long as it can drive the pinion gear 4.

As has been described heretofore, according to the engine starting apparatus according to the invention, any of the noise reduction, apparatus miniaturization and durability improvement can be attained.

What is claimed is:

1. An engine starting apparatus comprising:

a driven gear connected to an engine;

a starter motor adapted to be driven to rotate when said engine is started;

a speed-reducing and power-cut-off mechanism connected to said starter motor and having a rotatable output shaft, said speed-reduction and power-cut-off mechanism being adapted to output a rotation of said starter motor from said output shaft while reducing the rotational speed of the starter motor and to cut off power transmission between said starter motor and said output shaft when the rotational speed of said output shaft exceeds the reduced rotational speed of the starter motor;

a drive gear provided on said output shaft in such a manner as to be rotatable together with said output shaft and to move axially over said output shaft between an engagement position where said drive gear is brought into mesh engagement with said driven gear and a disengagement position where said drive gear is brought out of engagement with said driven gear; and a driving unit driving said drive gear to said engagement position when said engine is started and to said disengagement position after said engine has been started;

wherein the drive gear moves axially, independently of the speed-reduction and power-cut-off mechanism, and wherein said speed-reduction and power-cut-off mechanism is constituted by a wedge roller type speed reduction mechanism, said wedge roller type speed reduction mechanism including a plurality of rollers rotatably disposed around a rotational shaft of the starter motor; and a rotatable output shaft having an outer ring disposed around said plurality of rollers, said rotational shaft being offset from a rotational center of said outer ring, one of said rollers being movable between said rotational shaft and said outer ring so as to provide a wedge action for power transmission between said starter motor and said output shaft.

2. The engine starting apparatus according to claim 1, wherein said plurality of rollers are brought into abutment with said rotational shaft and an output ring via an oil film being interposed therebetween.

3. An engine starting apparatus comprising:

a driven gear connected to an engine;

a starter motor having a rotational shaft being driven to rotate when said engine is started;

a speed-reduction and power-cut-off mechanism having a plurality of rollers rotatably disposed around the rotational shaft of the starter motor; and a rotatable output shaft having an outer ring disposed around said plurality of rollers, said rotational shaft being offset from a rotational center of said outer ring, one of said rollers being movable between the rotational shaft and said outer ring so as to provide a wedge action for power transmission between said starter motor and said output shaft;

a drive gear provided on said output shaft in such a manner as to be rotatable together with said output shaft and to move axially over said output shaft between an engagement position where said drive gear is brought into mesh engagement with said driven gear and a disengagement position where said drive gear is brought out of engagement with said driven gear; and a driving unit driving said drive gear to said engagement position when said engine is started and to said disengagement position after said engine has been started, and wherein the drive pear moves axially, independently of the speed-reduction and power-cut-off mechanism.

4. The engine starting apparatus according to claim 3, wherein said plurality of rollers are brought into abutment with said rotational shaft and an output ring via an oil film being interposed therebetween.

* * * * *